US009930468B2

(12) United States Patent
Christoph et al.

(10) Patent No.: US 9,930,468 B2
(45) **Date of Patent: *Mar. 27, 2018**

(54) AUDIO SYSTEM PHASE EQUALIZATION

(71) Applicant: Apple Inc., Cupertino, CA (US)

(72) Inventors: Markus Christoph, Straubing (DE); Leander Scholz, Salching (DE)

(73) Assignee: APPLE INC., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/720,494

(22) Filed: May 22, 2015

(65) Prior Publication Data

US 2015/0373476 A1 Dec. 24, 2015

Related U.S. Application Data

(63) Continuation of application No. 12/917,604, filed on Nov. 2, 2010, now Pat. No. 9,049,533.

(51) Int. Cl.
*H04R 1/40* (2006.01)
*H04S 7/00* (2006.01)

(52) U.S. Cl.
CPC ..... *H04S 7/302* (2013.01); *H04S 7/301* (2013.01); *H04R 2499/13* (2013.01)

(58) Field of Classification Search
CPC ..... H04R 2205/022; H04R 2/022; H04S 1/00; H04S 1/002; H04S 1/005; H04S 1/007; H04S 2400/09; H04S 2400/11; H04S 2400/15; H04S 2420/01; H04S 2420/05;
(Continued)

(56) References Cited

U.S. PATENT DOCUMENTS 4,817,162 A * 3/1989 Kihara ..... H04S 1/002 381/1
5,033,092 A 7/1991 Sadale
(Continued)

FOREIGN PATENT DOCUMENTS

EP 1487236 12/2004
JP 63173500 7/1988
(Continued)

*Primary Examiner* — Leshui Zhang
(74) *Attorney, Agent, or Firm* — Womble Bond Dickinson (US) LLP

(57) ABSTRACT

A method is provided for optimizing acoustic localization at one or more listening positions in a listening environment such as, but not limited to, a vehicle passenger compartment. The method includes generating a sound field with a group of loudspeakers assigned to at least one of the listening positions, the group of loudspeakers including first and second loudspeakers, where each loudspeaker is connected to a respective audio channel; calculating filter coefficients for a phase equalization filter; configuring a phase response for the phase equalization filter such that binaural phase difference ($\Delta\varphi_{mn}$) at the at least one of the listening positions or a mean binaural phase difference ($m\Delta\varphi_{mn}$) averaged over the listening positions is reduced in a predefined frequency range; and filtering the audio channel connected to the second loudspeaker with the phase equalization filter.

14 Claims, 16 Drawing Sheets

(58) Field of Classification Search
CPC . H04S 2420/07; H04S 2420/13; G10K 15/10; G10K 15/12
USPC ..... 381/1, 2, 24, 26, 86, 17, 37, 80, 85, 97, 381/98, 99, 122, 20, 107, 300, 302, 303, 381/307, 56, 58, 59, 23.1, 60, 89, 100, 381/101, 103, 332, 320, 316, 313; 700/94
See application file for complete search history.

(56) References Cited

U.S. PATENT DOCUMENTS 5,208,860 A * 5/1993 Lowe ..... H04S 1/002 381/17
5,235,646 A * 8/1993 Wilde ..... H04S 5/00 381/17
5,684,881 A * 11/1997 Serikawa ..... H04S 1/007 381/1
5,892,831 A * 4/1999 Schott ..... H04S 1/002 381/1
6,118,875 A * 9/2000 Møller ..... H04S 1/005 381/1
6,370,255 B1 * 4/2002 Schaub ..... H04R 25/505 381/104
6,373,955 B1 4/2002 Hooley
6,683,962 B1 * 1/2004 Griesinger ..... H04S 1/002 381/1
6,718,042 B1 * 4/2004 McGrath ..... H04S 3/004 381/17
6,798,889 B1 * 9/2004 Dicker ..... H04S 7/301 381/103
6,967,541 B2 11/2005 Hooley
7,215,788 B2 5/2007 Hooley
8,027,479 B2 * 9/2011 Villemoes ..... G10L 19/008 381/22
8,050,717 B2 * 11/2011 Sugiyama ..... H04R 1/406 324/130
8,144,882 B2 3/2012 Christoph et al.
8,385,556 B1 * 2/2013 Warner ..... G10L 19/008 381/106
2001/0043652 A1 11/2001 Hooley
2004/0247141 A1 12/2004 Holmi et al.
2005/0078839 A1 * 4/2005 Miura ..... H04R 3/14 381/98
2005/0254343 A1 11/2005 Saiki et al.
2005/0265559 A1 * 12/2005 Asada ..... H04S 7/301 381/18
2006/0049889 A1 3/2006 Hooley
2006/0067541 A1 * 3/2006 Yamada ..... G10H 1/361 381/98
2007/0025559 A1 2/2007 Mihelich et al.
2007/0269061 A1 * 11/2007 Kim ..... H04S 7/303 381/303
2008/0025534 A1 * 1/2008 Kuhn ..... H04S 7/30 381/300
2008/0049948 A1 * 2/2008 Christoph ..... H04S 7/301 381/86
2009/0034772 A1 * 2/2009 Iida ..... H04S 7/302 381/356
2009/0046864 A1 * 2/2009 Mahabub ..... H04S 7/30 381/17
2010/0183158 A1 * 7/2010 Haykin ..... H04R 25/552 381/23.1
2010/0303266 A1 * 12/2010 Chen ..... H04R 27/00 381/310
2011/0135098 A1 * 6/2011 Kuhr ..... H04S 3/004 381/17
2011/0206209 A1 * 8/2011 Ojala ..... G10L 19/008 381/1

FOREIGN PATENT DOCUMENTS

JP 03195199 8/1991
JP 03211999 9/1991
JP 09027996 1/1997
JP 11252698 9/1999

* cited by examiner

AUDIO SYSTEM PHASE EQUALIZATION

CLAIM OF PRIORITY

This application is a continuation of co-pending U.S. application Ser. No. 12/917,604 filed on Nov. 2, 2010, which claims priority from EP Patent Application No. EP20090174806 filed on Nov. 2, 2009, which is hereby incorporated by reference.

FIELD OF TECHNOLOGY

The invention relates generally to phase equalization in audio systems and, in particular, to reducing an interaural time difference for stereo signals at listening positions in a listening environment such as a vehicle passenger compartment.

RELATED ART

Advanced vehicular sound systems, especially in luxury-class limousines, typically include a plurality of single loudspeakers configured into highly complex arrays located at different positions in a passenger compartment of the vehicle. The loudspeakers and arrays are typically dedicated to diverse frequency bands such as sub-woofers, woofers, midrange and tweeter speakers, et cetera.

Such prior art sound systems are manually tuned optimized) by acoustic engineers individually for each vehicle. Typically, the tuning is performed subjectively based on experience and "trained" hearing of the acoustic engineers. The acoustic engineers may use signal processing circuits such as biquadratic filters (e.g., high-pass, band-pass, low-pass, all-pass filters), bilinear filters, digital delay lines, cross-over filters and circuits for changing a signal dynamic response (e.g., compressors, limiters, expanders, noise gates, etc.) to set cutoff frequency parameters for the cross-over filters, the delay lines and the magnitude frequency response. In particular, the cutoff frequency parameters can be set such that the sound impression of the sound system is optimized for spectral balance (i.e., tonality, tonal excellence) and surround (i.e. spatial balance, spatiality of sound).

The main objective during the tuning of a sound system is to optimize audio at each listening position (e.g., at each seating position in the vehicle passenger compartment). Interaural time differences at the different listening positions or seating positions in a motor vehicle may significantly influence how the audio signals are perceived in surround and how they are localized stereophonically.

There is a general need, therefore, for a method that reduces the interaural time difference at arbitrary listening positions within a vehicle passenger compartment, especially at listening positions arranged outside the axis of symmetry in the car.

SUMMARY OF THE INVENTION

According to one aspect of the invention, a method is provided for optimizing acoustic localization at least at one listening position in a listening environment. A sound field is generated by a group of loudspeakers assigned to the at least one listening position. The group of loudspeakers includes a first and at least a second loudspeaker, where each loudspeaker receives an audio signal from an audio channel. The method includes the steps of calculating filter coefficients of a phase equalization filter for at least the audio channel supplying the second loudspeaker, where a phase response of the phase equalization filter is configured such that a binaural phase difference ($\Delta\varphi_{mn}$) at the listening position or a mean binaural phase difference ($m\Delta\varphi_{mn}$) averaged over a plurality of listening positions is reduced in a predefined frequency range; and filtering the respective audio channel with the phase equalization filter.

According to another aspect of the invention, a system is provided for optimizing acoustic localization at least at one listening position in a listening environment. The system includes a group of loudspeakers, a signal source, and a signal processing unit. The group of loudspeakers are assigned to the at least one listening position for generating a sound field. The group of loudspeakers includes a first and at least a second loudspeaker. The signal source provides an audio signal to each loudspeaker using a respective audio channel. The signal processing unit calculates filter coefficients for a phase equalization filter that is applied to at least the audio channel supplying the second loudspeaker. A phase response of the phase equalization filter reduces a binaural phase difference ($\Delta\varphi_{mn}$) at the listening position or a mean binaural phase difference ($m\Delta\varphi_{mn}$) averaged over a plurality of listening positions in a predefined frequency range.

According to another aspect of the invention, a method is provided for optimizing acoustic localization at one or more seating positions in a vehicle passenger compartment. The method includes the steps of generating a sound field with a group of loudspeakers assigned to at least one of the listening positions, the group of loudspeakers including first and second loudspeakers, where each loudspeaker is connected to a respective audio channel; calculating filter coefficients for a phase equalization filter; configuring a phase response for the phase equalization filter such that binaural phase difference ($\Delta\varphi_{mn}$) at the at least one of the listening positions or a mean binaural phase difference ($m\Delta\varphi_{mn}$) averaged over the listening positions is reduced in a predefined frequency range; and filtering the audio channel connected to the second loudspeaker with the phase equalization filter.

The binaural phase difference ($\Delta\varphi_{mn}$) is preferably minimized.

DESCRIPTION OF THE DRAWINGS

The invention can be better understood with reference to the following drawings and description. Components in the figures are not necessarily to scale, instead emphasis is placed upon illustrating the principles of the invention. Moreover, in the figures, like reference numerals designate corresponding parts or elements. In the drawings.

DETAILED DESCRIPTION OF THE INVENTION

Figure 1:
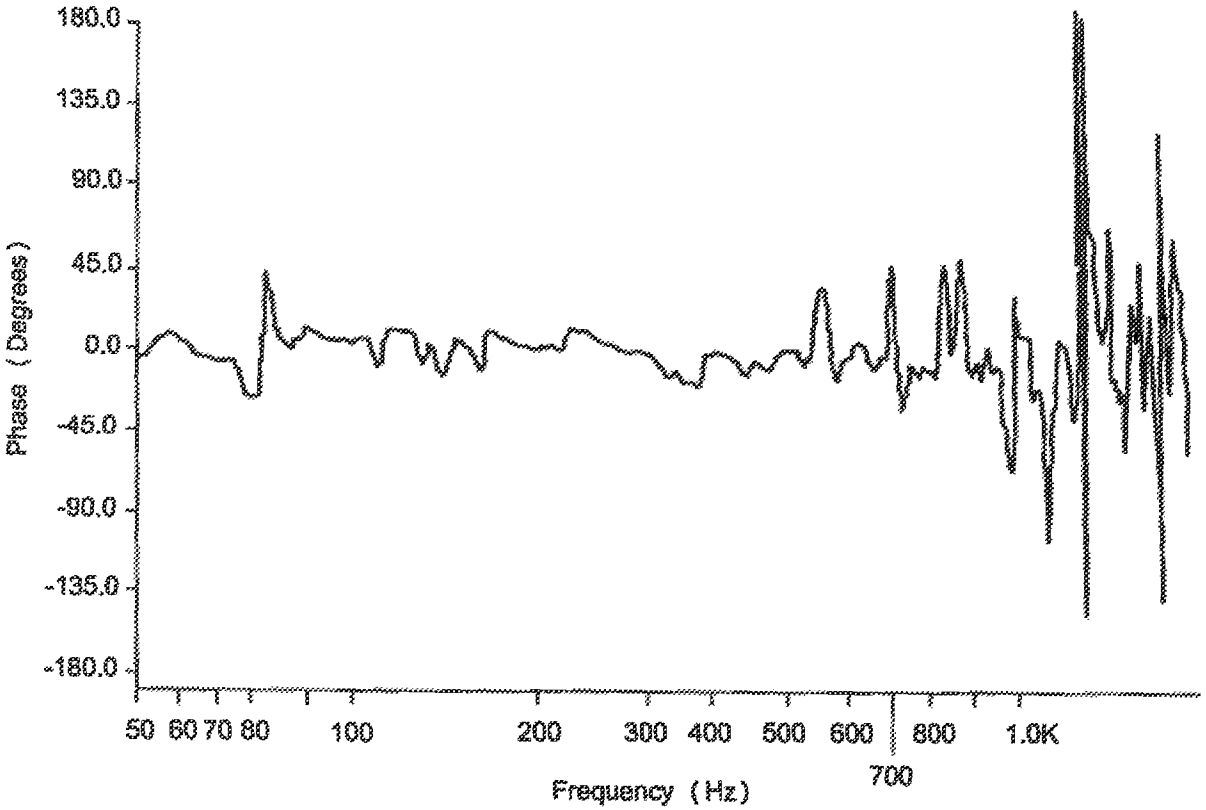
FIG. 1 is a graphical representation of a binaural phase difference measured using a dummy head located on an axis of symmetry.

Various acoustic circuits have been used over the years to manually tune audio systems. Delay lines, for example, may be used to adjust phase by equalizing delay in individual amplifier channels. The phase response may be directly modified using, for example, ail-pass filters. Crossover filters may be used to limit transfer bands in the individual loudspeakers in order to adjust the phase response in audio signals reproduced by the loudspeakers. Different types of filters (e.g., Butterworth, Bessel, Linkwitz-Riley, etc.) may be included within the audio system to positively adjust the sound by changing phase transitions.

Advances in digital signal processors have increased filter flexibility, while reducing costs. The increased flexibility has enabled, for example, the magnitude and the phase frequency response to be individually set. A signal processor can be configured, for example, as an Infinite Impulse Response ("IIR") filter. Finite Impulse Response ("FIR") filters, however, are typically used rather than IIR filters because IIR filters are relatively difficult to configure.

FIR filters have a finite impulse response and operate using discrete time steps. The time steps are typically determined by a sampling frequency of an analog signal. An Nth order FIR filter may be defined by the following differential equation:

$$y[n] = b_0 \cdot x[n] + b_1 \cdot x[n-1] + b_2 \cdot x[n-2] + \ldots + b_{N-1} \cdot x[n-N] \quad (1)$$

$$= \sum_{i=0}^{N-1} b_i \cdot x[n-i],$$

where y(n) is a starting value at a point in time n (n is a sample number and, thus, a time index) obtained from the sum of the actual and an N last sampled input values x(n−N−1) to x(n) weighted with the filter coefficients $b_i$. The desired transfer function is realized by specifying the filter coefficients $b_i$.

Relatively long FIR filters may be implemented with a typical digital signal processor using diverse signal processing algorithms, such as, for example, partitioned fast convolution. Such long FIR filters can also be implemented using filter banks. Long FIR filters permit the phase frequency response of audio signals to be adjusted for a longer lasting improvement of the acoustics and, especially, the localization of audio signals at diverse listening positions in the vehicle passenger compartment.

Localization refers to the ability of a listener to identify, using his ears (binaural hearing), the location of a sound source (or origin of a sound signal) in both direction (e.g., horizontal direction) and distance. A listener, for example, may use aural perception to evaluate differences in signal delay and signal level between both ears in order to determine from which direction (e.g., left, straight ahead, right) a sound is being produced.

The listener evaluates differences in delay between both ears (termed "interaural time difference" or "ITD") when determining from which direction the perceived sound is coming. Sound coming from the right, for example, reaches the right ear before reaching the left ear. At this point, a distinction should be made between evaluation of phase delay at low frequencies, evaluation of group delay at high frequencies and evaluation of level differences as a function of frequency between both ears (termed "interaural level difference" or "ILD").

Sound coming from the right has a higher level at the right ear than at the left ear because the head of the listener shadows the sound at the left ear. The level differences are a function of frequency, and increase with increasing frequency. Differences in delay (e.g., phase delay or differences in the delay) may be evaluated at low frequencies (e.g., below approximately 800 Hz). Level differences may be evaluated at high frequencies (e.g., above approximately 1500 Hz). Both the differences in delay and the level differences, however, may be evaluated to varying degrees at mid range frequencies (e.g., between 800 and 1500 Hz).

A distance of approximately 21.5 cm between the right and the left ears of a listener corresponds to a difference in delay of approximately 0.63 ma at low frequencies. The dimensions of the head therefore are smaller than half the wavelength of the sound. In this frequency range, the human ear can evaluate the differences in the delay between both ears relatively well. The level differences may be so small, however, that they cannot be evaluated with any precision. Frequencies below 80 Hz, for example, typically cannot be localized in direction. This is because the dimensions of the human head are smaller than the wavelength of the sound. The human ear therefore is no longer able to determine the direction from the differences in delay. As the interaural level differences become larger, however, they can be evaluated by the human ear.

Objective results can be obtained when measuring the aforesaid variables by using one or more so-called dummy heads. The dummy heads replicate the shape and the reflection/diffraction properties of a human head. Each dummy head includes two microphones, in place of ears, for measuring audio signals arriving under various conditions. Advantageously, the dummy heads can be repositioned around the listening room to measure signals at different listening positions.

In addition to evaluating the interaural level difference for various frequencies, the group delay between the right and the left ears may be evaluated. When a new sound is reproduced, for example, its direction can be determined from the delay in the sound occurrence between the right and the left ears. The evaluation of group delay is particularly important in environments that induce reverberation. For example, there is a short period of time between when an initial sound reaches the listener and when a reflection of the initial sound reaches the listener. The ear uses this period of time to deter mine the directionality of the initial sound. The listener typically remembers the measured direction of the initial sound until a new direction may be determined; e.g., after the reverberation of the initial sound has terminated. This phenomenon is called "Haas effect", "precedence effect" or "law of the first wave front".

Sound source localization is perceived in so-called frequency groups. The human hearing range is divided into approximately 24 frequency groups. Each frequency group is 1 Bark or 100 Mel wide. The human ear evaluates common signal components within a frequency group in order to determine the direction of the sound source.

The human ear combines sound cues occurring in limited frequency bands termed "critical frequency groups" or "critical bandwidth" (CB), the width of which is based on an ability of the human ear to combine sounds occurring in certain frequency bands into a common auditory sensation for psychoacoustic auditory sensations emanating from the sounds. Sound events occurring in a single frequency group have a different effect than sound events occurring in a variety of frequency groups. Two tones having the seine level in a frequency group, for example, are perceived as softer than when occurring in a variety of frequency groups.

The bandwidth of the frequency groups can be determined when a test tone within a masker is audible. The test tone is audible when the test tone and the masker have the same energies, and the test tone and the center hand of the masker are in the same frequency band. At low frequencies, the frequency groups have a bandwidth of, for example, approximately 100 Hz. At frequencies above 500 Hz, the frequency groups have a bandwidth equal to approximately 20% of the center frequency of a respective frequency group. See Zwicker, E. and Fastl, H., *Psychoacoustics—Facts and Models,* $2^{nd}$ edition, Springer-Verlag, Berlin/Heidelberg/New York, 1999.

A hearing oriented non-linear frequency scale termed "pitch" includes each critical frequency group lined up over the full hearing range. The pitch has a unit of a "Bark". The pitch represents a distorted scaling of the frequency axis, where the frequency groups have a 1 Bark width at each point. The non-linear relationship of the frequency and the pitch has its origin in the frequency/location transformation on a basilar membrane. The pitch function was formulated by Zwicker (see Zwicker, E. and Fastl, H., *Psychoacoustics—Facts and Models,* $2^{nd}$ edition, Springer-Verlag, Berlin/Heidelberg/New York, 1999) after testing listening thresholds and loudness in the form of tables and equations. The testing demonstrated that 24 frequency groups are lined up in the audible frequency range of 0 to 16 kHz. The corresponding pitch range is between 0 and 24 Bark. The pitch z in Bark can be calculated as follows:

$$z/\text{Bark} = 13 * \arctan\left(0.76\frac{f}{\text{kHz}}\right) + 3.5 * \arctan\left(\frac{f}{7.5\ \text{kHz}}\right)^2,$$

and the corresponding frequency group width $\Delta f_G$ can be calculated as follows:

$$\Delta f_G/\text{Hz} = 25 + 75 * \left[1 + 1.4 * \left(\frac{f}{\text{kHz}}\right)^2\right]^{0.69}.$$

A listener typically perceives both sound from the direction of the sound system and sound reflected from walls in a closed environment such as a passenger compartment of a vehicle. When determining the direction of the sound source, however, the listener evaluates the first direct sound to arrive opposed to a reflected sound arriving after the direct sound (law of the first wave front). This is accomplished by evaluating strong changes in loudness with time in different frequency groups. A strong increase in loudness in one or more frequency groups, for example, typically indicates that the direct sound of a sound source or the signal of which alters the properties has been heard. The direction of the sound source is determined in the brief period of time between hearing the direct sound and its reflected signal.

Reflected sound heard after the direct sound does not significantly alter the loudness in the frequency groups and, therefore, does not prompt a new determination of direction. In other words, the direction determined for the direct sound is maintained as the perceived direction of the sound source until a new direction can be determined from a signal with a stronger increase in loudness. At a listening position midway between two loudspeakers or between the centers of two loudspeaker arrays, high localization focus and, thus, symmetrical surround perception can automatically materialize. This consideration assumes, however, that the signal is projected each time with the same level and same delay between the left-hand and right-hand stereo channels.

Most listening positions in a typical vehicle passenger compartment are located outside of the axis of symmetry. Disadvantageously, in such cases, equalizing the level alone does not provide "good" localization. Adapting the amplitude of the signals from the left-hand and right-hand stereo channels to compensate the difference in their angle of projection also does not provide "good" localization. In other words, the perception of being on the axis of symmetry between stereo loudspeakers cannot be achieved by equalizing the level, or by compensating for differences in angle of projection alone.

A simple measurement may be used to demonstrate how phasing can alter differences in delay when the seating positions are not on the axis of symmetry between the loudspeakers. By positioning a dummy head, as described above, to simulate the physiology of a listener within a passenger compartment in the longitudinal centerline between the loudspeakers, and by measuring the binaural phase difference it can be shown that both stereo signals agree to a very high degree. For example, the results of a corresponding measurement in the psychoacoustically relevant domain up to approximately 1500 Hz are shown from FIG. 1.

Referring to FIG. 1, a curve is shown that represents the phase difference between the left-hand and the right-hand measurement signal from microphones located on the axis of symmetry in a vehicle passenger compartment of a vehicle. The phase difference is plotted in degrees as a function of the logarithmic frequency. The phase difference of the two measurement signals for frequencies below 100 Hz is relatively small, and does not exceed 45 degrees in either the positive or the negative direction.

Figure 2:
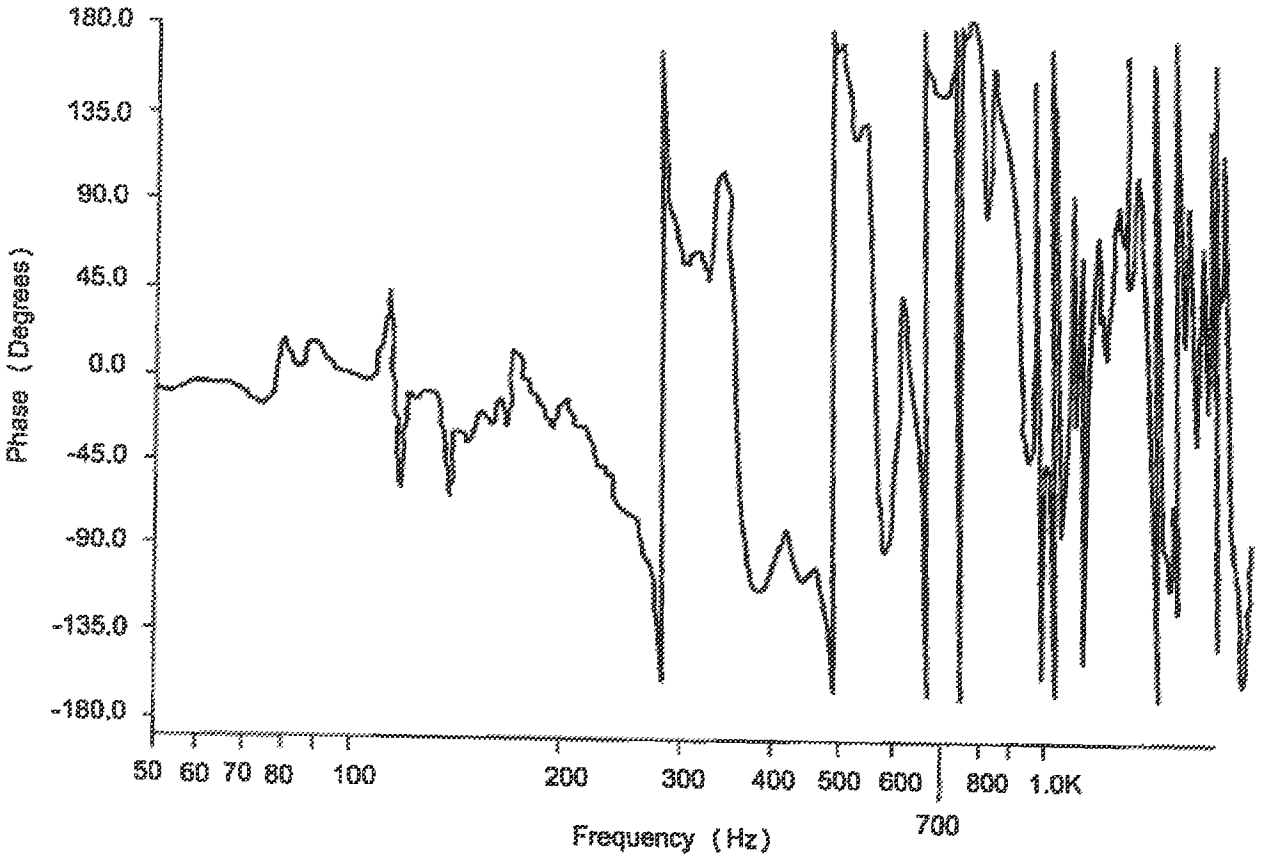
FIG. 2 is a graphical representation of a binaural phase difference measured using a dummy head located at a driver seat outside the axis of symmetry.

Referring to FIG. 2, a curve is shown that represents the phase difference between the left-hand and the right-hand measurement signal from microphones located in a driver location (i.e., outside the axis of symmetry). The phase difference is plotted in degrees as a function of the logarithmic frequency. The phase difference of the two measurement signals exceeds 45 degrees in the positive and the negative directions for frequencies above 100 Hz. The phase difference reaches 180 degrees at frequencies above approximately 300 Hz. By comparing FIGS. 1 and 2, therefore, it is evident that a listening position outside of the axis of symmetry between the loudspeakers (e.g., at the driver's seat) can create a significantly greater phase difference between signals arriving at the left and the right ear. This phase difference can, in turn, be detrimental to the localization of the audio signals.

The aforedescribed methods for manually adjusting (i.e., tuning) the phase are used to position and configure the "stage" for good acoustics. Equalizing the magnitude frequency response, in contrast, serves to adjust the so-called "tonality". These objectives are also considered by the disclosed method; i.e., providing an arbitrarily predefined target function while also equalizing the magnitude frequency response. Focusing the disclosed method on phase equalization serves to further enhance rendering the stage symmetric and distance at all possible listening positions in the vehicle, as well as to improve accuracy of localization whilst maintaining a realistic stage width.

Some researchers have used the phase to reduce a comb filter effect caused by the disparate phasing of the various loudspeakers at a point of measurement. The comb filter effect is reduced in order to generate an improved magnitude frequency response that is more spectrally closed. While this method can improve localization, it does not provide conclusions as to the quality of the localization.

Using a FIR all-pass filter designed to replicate a desired phase frequency response for phase equalization influences not only the phase, but also the magnitude frequency response. This can cause narrow band glitches of differing magnitude. In addition, phase equalizers with long impulse responses can be detrimental to sound perception. Testing the impulse responses in phase equalization has demonstrated that there is a direct connection between tonal disturbances and how the group delay of a phase equalizer is designed. Large and abrupt changes in a narrow spectral band of the group delay of the phase equalizer, teemed "temporal diffusion", can induce an oscillation within the impulse response similar to high Q-factor/gain filters. In other words, the more dynamic the deviation in a narrow spectral band, the longer a tonal disturbance lasts, which can be disruptive. When an abrupt change in the group delay is in a relatively low frequency band, in contrast, the tonal disturbances are reduced and, therefore, less disruptive. These attributes should be taken into account when designing phase equalizers, for example, by hearing-oriented smoothing such that the impulsiveness of an audio system is not degraded. In other words, the group delay of a phase equalizer should have a reduced dynamic response to higher frequencies in order to enhance impulsiveness.

Filters for magnitude equalization, in addition to filters for phase equalization, can also influence the impulsiveness of an audio system. Such filters for magnitude equalization, similar to the aforedescribed filters for phase equalization (i.e., phase equalizers), are used for a hearing-oriented non-linear, complex smoothing. It should be noted that impulsiveness is also influenced by the design of the filter for magnitude equalization. In other words, disturbances can be increased or decreased depending on whether the predefined desired curves of the magnitude frequency response are converted linearly or minimum phased.

Minimum-phase filters should be used for magnitude equalization to enhance impulsiveness, even though such filters have a certain minimum phase response that should be accounted for when implementing phase equalization. Such a compromise also applies to other components that influence the phase such as delay lines, crossover filters, et cetera. Advantageously, minimum-phase filters use approximately half as many filter coefficients to provide a similar magnitude frequency response as compared to a linear phase filter. Minimum-phase filters therefore have a relatively high efficiency.

The following describes how equalizing the phase response as a function of the frequency can be implemented to improve localization. Typically, three basic factors influence horizontal localization. These factor include (i) the above-mentioned Haas effect or precedence effect, also termed the law of the first wavefront, (i) interaural time difference (ITD) and (iii) interaural level difference (ILD). The precedence effect is predominantly effective in a revert surround, where the interaural time difference in the lower spectral band is roughly 1500 Hz according to Blauert and/or where the interaural level difference is above approximately 4000 Hz. The spectral range of interest for the localization considered by the embodiment described below, however, is in the audible frequency range up to approximately 1500 Hz. The interaural time differences (ITD) therefore are the primary consideration when analyzing or modifying the localization as perceived by a listener.

Artificial heads (hereinafter "dummy heads") may be used to measure binaural room impulse responses (BRIR) of each loudspeaker at each seating position in the vehicle passenger compartment. Each dummy head includes a set of microphones located thereon to correspond to the location of ears on a human head. Each dummy head may be mounted on a mannequin. The remaining seats in the vehicle passenger compartment may be occupied with live passengers and/or additional mannequins or may be left unoccupied depending on the type of tuning (i.e., driver optimized tuning, front optimized tuning, rear optimized tuning, or tuning optimized for all positions).

Figure 3:
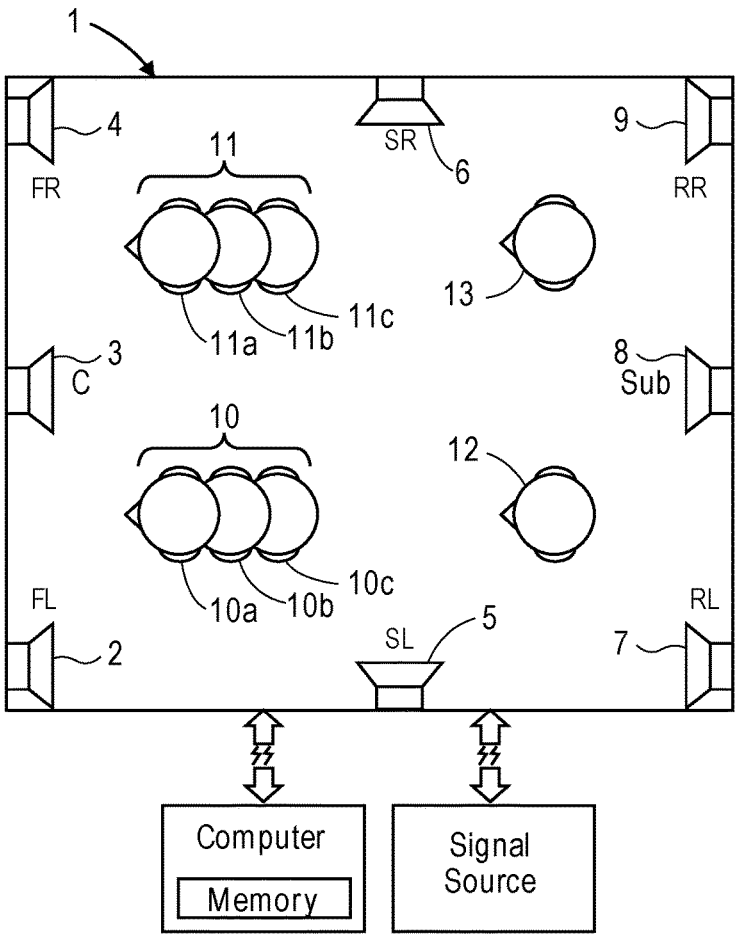
FIG. 3 an overhead diagrammatic illustration of a vehicle passenger compartment shown with a plurality of dummy heads for measuring/testing audio at a plurality of listening/seating positions.
Figure 4:
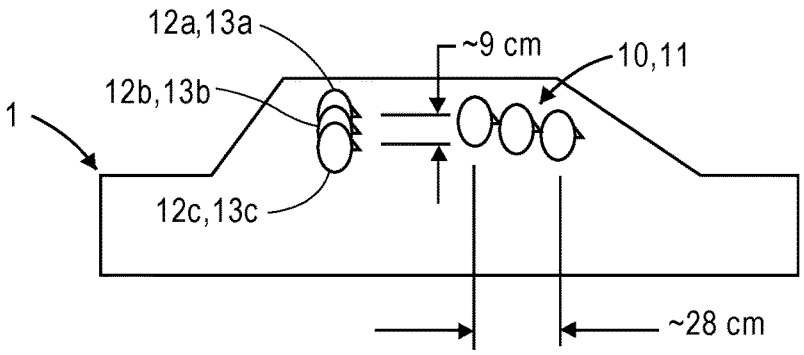
FIG. 4 is a side view of the vehicle passenger compartment shown in FIG. 3.

Referring to FIGS. 3 and 4, a vehicle passenger compartment 1 is shown with an audio system and a plurality of the dummy heads. The audio system includes a front left loudspeaker 2, a front center loudspeaker 3, a front right loudspeaker 4, a side left loudspeaker 5, a side right loudspeaker 6, a rear left loudspeaker 7, a rear center subwoofer 8 and a rear right loudspeaker 9. Each dummy head is positioned to measure/test audio at a respective one of a plurality of listening positions. The listening positions may include a front-left (or driver) seating position 10, a front-right seating position 11, a rear-left seating position 12 and a rear-left seating position 13.

Referring to FIG. 3, the driver seating position 10 may be longitudinally located in a forward position 10*a*, a center position 10*b* or a rear position 10*c* by adjusting, for example, the driver seat in the passenger compartment 1. The front-right seating position 11 may be longitudinally located in a forward position 11*a*, a center position 11*b* or a rear position 11*c* by adjusting, for example, the front passenger seat in the passenger compartment 1.

Referring now to FIG. 4, the dummy heads positioned in the driver and the front-right seating positions 10 and 11 may be raised or lowered as a function of their forward, center or rear positions in order to account for different heights of occupants who would be sitting in the driver and the front passenger seats. The dummy heads positioned in the rear-left and the rear-right seating positions 12 and 13 may also be raised or lowered to account for different heights of occupants who would be sitting in the rear passenger seats. The heights of these dummy heads may be adjusted, for example, to measure the audio in upper positions 12*a* and 13*a*, center positions 12*b* and 13*b*, and lower positions 12*c* and 13*c*. The arrangement shown in FIGS. 3 and 4 is configured to replicate differences in stature size and, thus, differences in the listening positions as to the ears of the occupants (passengers) in the vehicle passenger compartment 1.

Horizontal localization in the from seating positions is a function of audio reproduced by the front left loudspeaker 2, the front right loudspeaker 4 and, when included, the front center loudspeaker 3. Similarly, horizontal localization in the rear seating positions is a function of audio reproduced by the front loudspeakers 2, 3 and 4, the rear left and the rear right loudspeakers 7 and 9, and the side left and the side right loudspeakers 5 and 6. Which loudspeakers influence localization in each seating position depends on the listening environment (i.e., the passenger compartment 1) and the arrangement of the loudspeakers in the listening environment. In other words, a defined group of loudspeakers is considered for each listening position, where each group of loudspeakers includes at least two single loudspeakers.

Analysis and filter synthesis may be performed offline once a binaural room impulse response (BRIR) is measured for each pair of listening position and loudspeaker (chosen from the relevant group). Superimposing the corresponding loudspeakers of the group, which is relevant for the considered listening position in taking into account techniques for tuning the phase, produces the wanted phase frequency response of the cross spectra.

Optimizing an interaural time difference (ITD) for the driver and the front-right seating positions 10 and 11 may be performed by imposing a phase shift from 0 to 180° in steps of for example, 1° to the audio signal supplied to the front left or the front right loudspeaker 2, 4. In other words, an audio signal of a certain frequency $f_m$ is supplied to the loudspeakers (e.g., the front left and the from right loudspeakers 2 and 4, when the front center loudspeaker 3 is not included) of the group assigned to the front seating positions. Phase shifts $\varphi_n$ from 0° to 180° are imposed on the audio signal supplied to the front left loudspeaker 2 or the front right loudspeaker 4, whereby the phase of the audio signal supplied to other loudspeakers remains unchanged. These phase shifts are performed for different frequencies in a given frequency range, for example between approximately 100 Hz and 1500 Hz. As indicated above, the frequency range below 1500 Hz is used for horizontal localization in a reverberant environment such as passenger compartments of a vehicle.

A phase difference $\Delta\varphi_{mn}$ can be calculated for each pair of frequency $f_m$ and phase shift $\varphi_n$ using the measured binaural room impulse responses (BRIR) for each considered listening position. The phase difference $\Delta\varphi_{mn}$ is indicative of the phase difference of the acoustic signal present at the two microphones the "ears") of a respective dummy head. In other words, the phase of the cross spectrum is calculated from the acoustic signals received by the "ears" of the dummy head located at the respective listening position.

The signal from either the front left loudspeaker 2 or front right loudspeaker 4 may be varied in phase. The phase difference $\Delta\varphi_{mn}$ of the cross spectrum in the spectral band of interest is calculated and entered into a matrix. Where multiple loudspeakers are included in a tested sound system, the signals of three of more loudspeakers may be varied in order to optimize results for the considered listening positions. In such a configuration, a three dimensional "matrix" of phase differences can be compiled. However, in order to avoid to complicating things the further discussion is confined to groups of loudspeakers comprising only two loudspeakers (e.g., front loudspeakers 3 and 4) so that only the audio signal of one loudspeaker has to be phase shifted.

Inserting phase shifts and calculating the resulting phase differences $\Delta\varphi_{mn}$ may be performed for each listening position that includes the same group of loudspeakers. The group in the present example includes the front left and right loudspeakers 2 and 4. This group of loudspeakers 2 and 4 is assigned to the six front listening positions (i.e., the forward driver seating position 10*a*, the center drive seating position 10*b*, the rear driver seating position 10*c*, the forward front-tight seating position 11*a*, the center front-right seating position 11*b* and the rear front-right seating position 11*c*). Six matrices $\Delta\varphi_{mn}$ can be calculated using the aforementioned procedure, where each matrix belongs to a specific listening position.

The phase differences $\Delta\varphi_{mn}$ calculated for each listening position may be averaged to calculate a matrix of mean phase differences $m\Delta\varphi_{mn}$. The mean phase difference $m\Delta\varphi_{mn}$ can be optimized to account for "good" localization at each of the considered listening positions.

Figure 5:
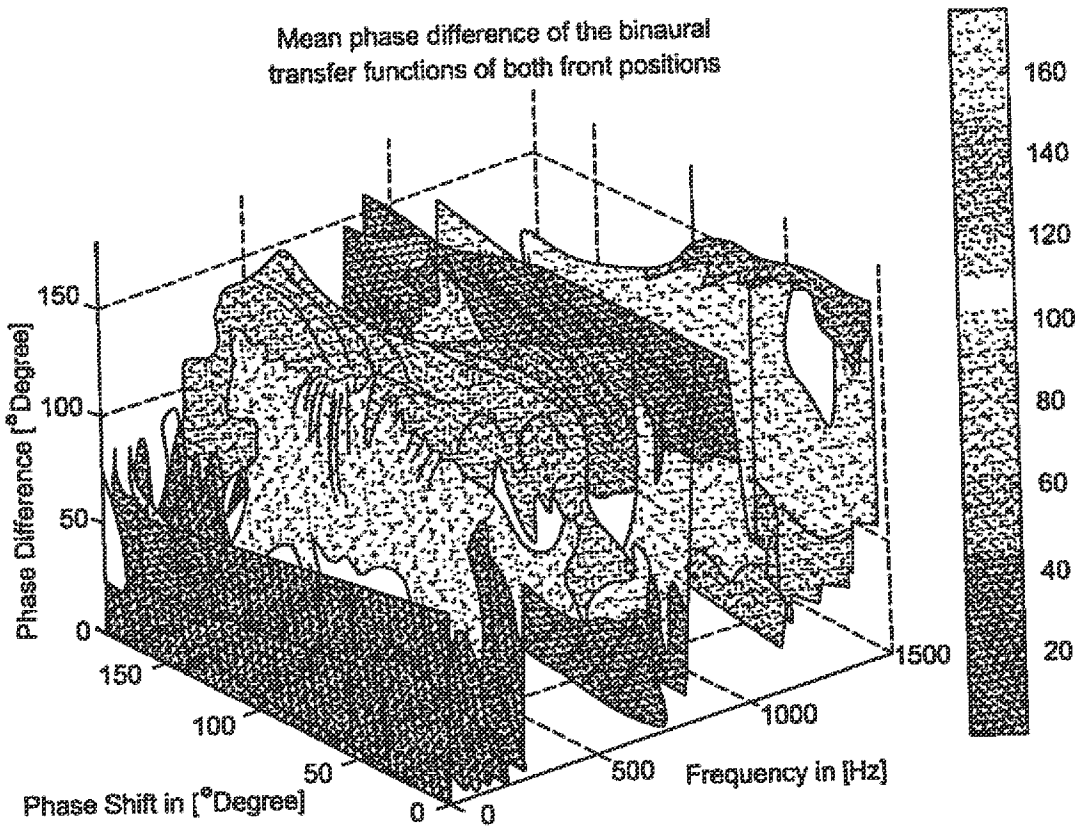
FIG. 5 is a graphical representation of the phase of the cross spectrum of the binaural transfer function as a Function of frequency at two different seating positions in the vehicle with application of a continuous phase shift from to 0° to 180° steps of 1° for the front left channel.

Referring to FIG. 5, a three-dimensional representation of the mean phase difference $m\Delta\varphi_{mn}$ is shown for phases of the cross spectra over the two front measurement positions 10 and 11 (e.g., the front center seating positions 10*b* and 11*b*). The y-axis shows the set phase shift $\varphi_{mn}$ from 0 to 180'. The z-axis shows the average phase difference $m\Delta\varphi_{mn}$ of the cross spectra. The x-axis shows the frequency $f_m$ as a function of the average phase difference $m\Delta\varphi_{mn}$. A line of minimum height (see also FIGS. 6 and 7) corresponds to the "optimum" phase shift in the sense of a "minimum" interaural time difference for corresponding respective seating position(s). Assuming the phase differences $m\Delta\varphi_{mn}$ form an N×N matrix (where the frequency index m runs from 0 to M−1 and the phase index n runs from 0 to N−1), the index X yielding the optimal shift $\varphi_X(f_m)$ at a frequency $f_m$ may be calculated as follows:

$$m\Delta\varphi_{mX}=\min\{m\Delta\varphi_{mn}\} \text{ for } n=0,1,\ldots,N-1,$$

where; in the example provided above, N=180 (i.e. $\varphi_n$=n° for n=0, 1, . . . , 179). For example, the number of frequency values M may be chosen where, for example, M=1500 (i.e., $f_m$=m Hz for m=1, 2, . . . , 1500). Alternatively, a logarithmic spacing may be chosen for the frequency values $f_m$. The optimal phase shift creates a minimum phase difference.

Figure 6:
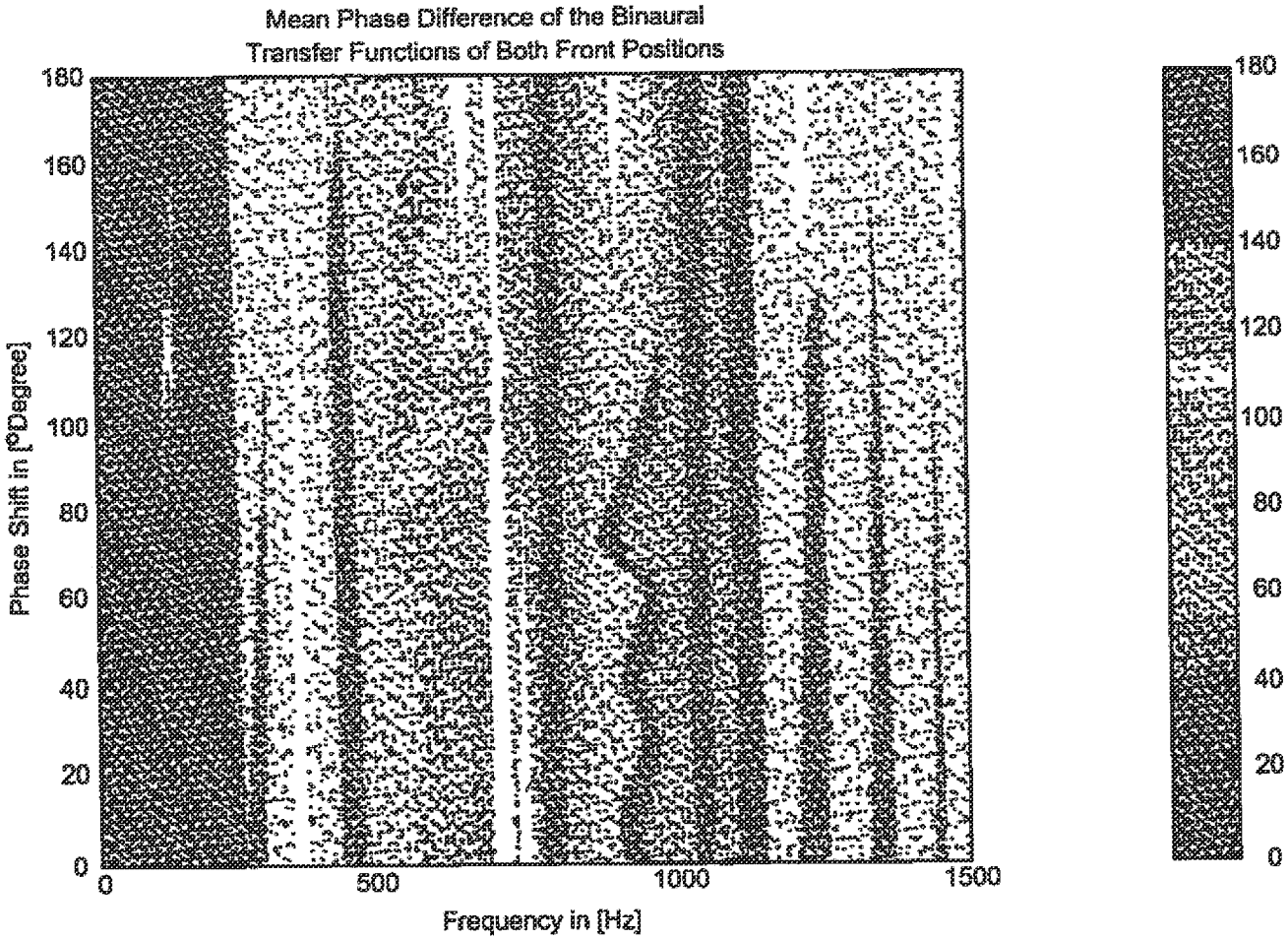
FIG. 6 is a top view of the three-dimensional representation of the phase of the cross spectrum as shown in FIG. 5 indicating the phase shift per frequency for the front left channel which minimizes the phase of the binaural cross spectrum.

Referring to FIG. 6, a top view is shown of the three-dimensional representation of the mean phase difference $m\Delta\varphi_{mn}$. The x-axis shows the measurement frequency $f_m$ in Hz. The y-axis shows the phase shift $\Delta\varphi_n$ imposed to the audio signal of the front left loudspeaker 2 shown in FIG. 3. Superimposed on the representation is the "line" of minimum height (e.g., the optimum phase shift $\varphi_X$ as a function of $f_m$) for the phase differences and, thus, for the interaural time difference (ITD) obtained as a minimum from the three-dimensional representation $m\Delta\varphi_{mn}$ as shown in FIG. 5.

Figure 7:
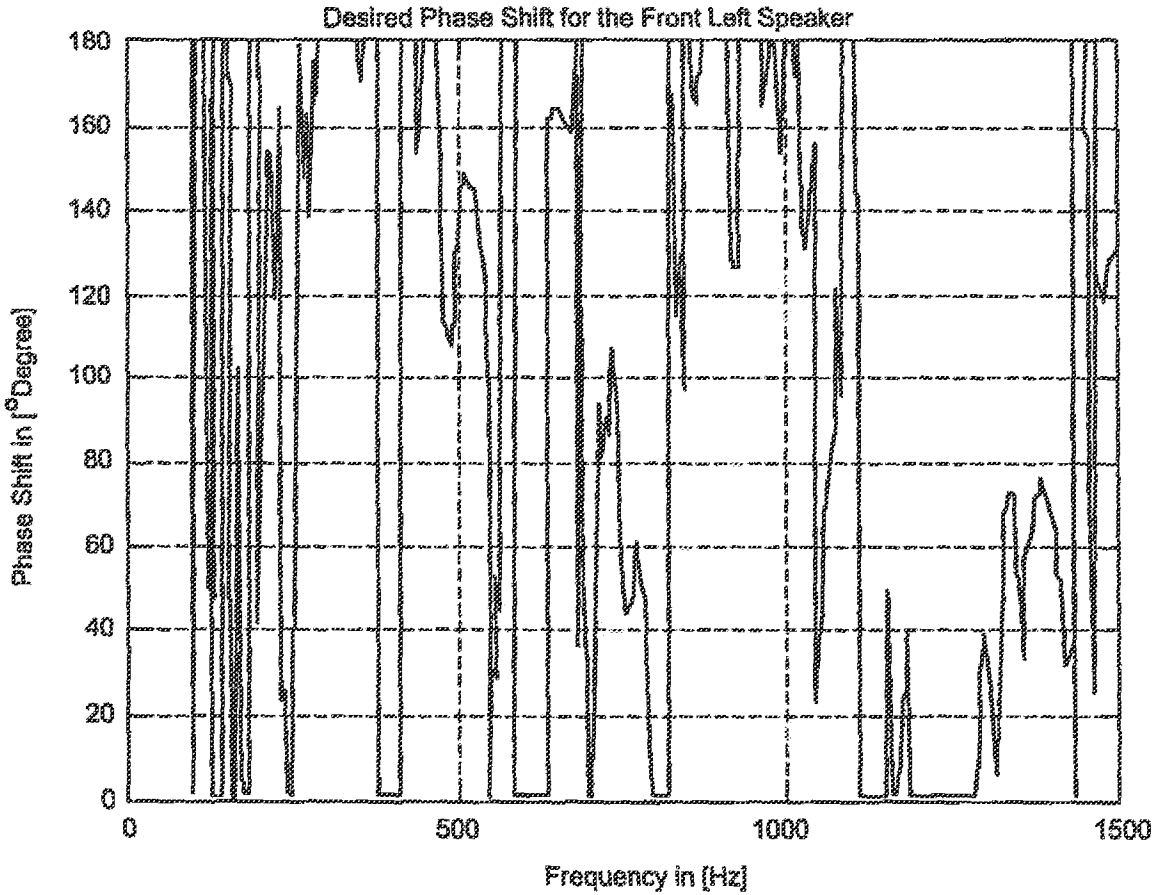
FIG. 7 is a graphical representation of an optimum phase shift for a front left channel of an audio system configured in the vehicle passenger compartment shown in FIGS. 3 and 4.

Referring to FIG. 7, a curve representative of the line of minimum "height" (e.g., the minimum phase difference) is shown isolated from the three-dimensional representation of the measured results in FIGS. 5 and 6. The x-axis shows the frequency $f_m$ in Hz. The y-axis shows the corresponding phase shift $\varphi_n$. The curve (i.e., the line of minimum height) shows the (frequency dependent) optimum phase shift $\varphi_X$ as an optimum for the front left channel, resulting in maximal minimization of the cross spectrum phase and thus optimum horizontal localization as averaged over the two front seating positions. Each of the two front seating positions can also be weighted optionally for computing the resulting cross spectrum. The results shown in FIGS. 6 and 7 are obtained from an equal weighting of the front left and right seating positions. Alternatively, the front left (driver) seating position may be weighted higher than other seating positions since the driver seating position is the most occupied seating position.

Localization may be improved using a filter that utilizes the matrix minima directly to form a phase equalizer as explained above. Such a filter, however, has a non-optimized impulsiveness. A compromise therefore is made between optimum localization and impulsiveness noise content.

The curve of the matrix minima $\varphi_X(f_m)$ may be for example smoothed using a sliding, nonlinear, complex smoothing filter, before the phase equalization filter is computed. An example of such a complex smoothing filter is disclosed in Mourjopoulos, John N. and Hatziantoniou, Panagiotis D., Real-Time *Room Equalization Based on Complex Smoothing: Robustness Results*, AES Paper 6070, AES Convention 116, May 2004, which is hereby incorporated by reference. During testing, the inventors found that smoothing the matrix minima $\varphi_X(f_m)$ provides relatively accurate localization while also enhancing the impulsiveness of the phase equalizer. The impulsiveness can be enhanced, for example, to a point where it is no longer experienced as a nuisance.

The smoothed optimum phase function $\varphi_{X,FILT}(f_m)$ is used as reference (i.e., as a design target) for the design of the phase equalizer to equalize the phase of the audio signal supplied to the loudspeaker under consideration (e.g., the front left loudspeaker 2). The equalizing filter may comprise any suitable digital filter such as a FIR filter, an IIR filter, et cetera.

Figure 8:
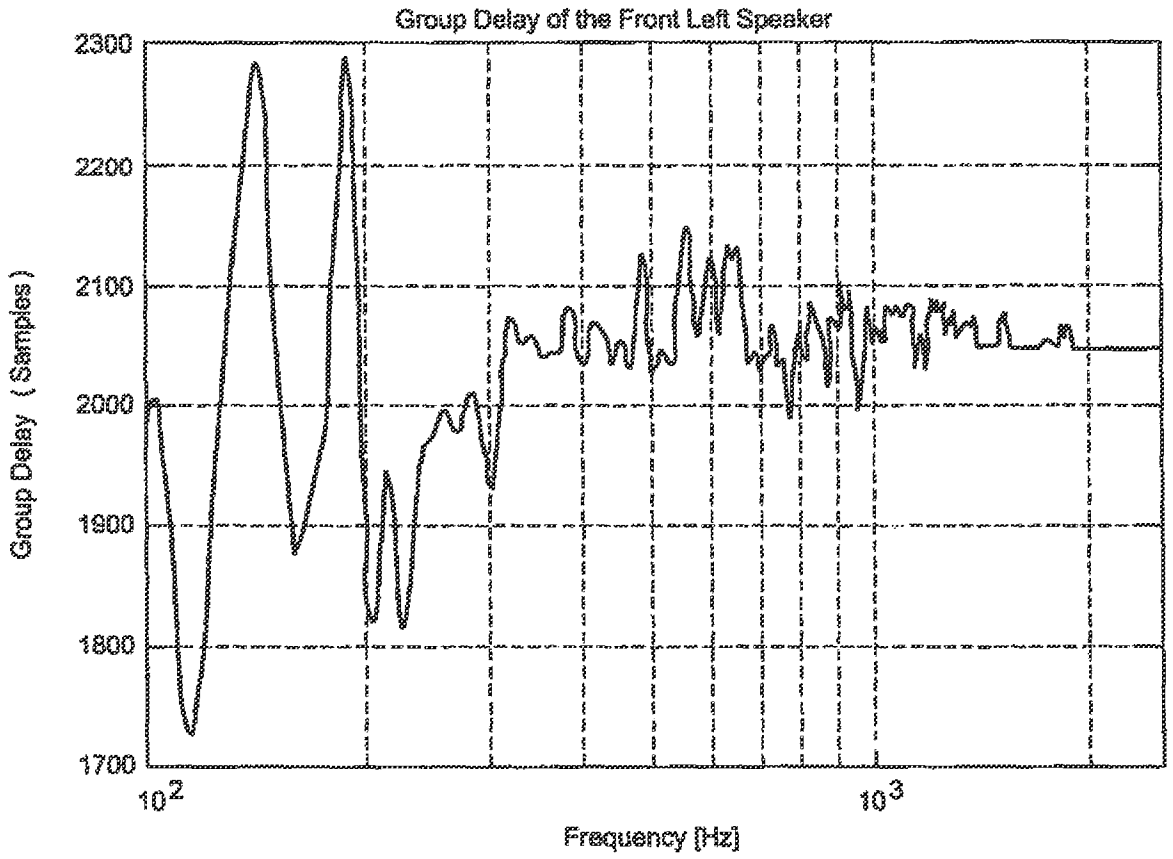
FIG. 8 is a graphical representation of a group delay of a phase equalizer for approximating the optimum phase shift as shown in FIG. 7.

Referring to FIG. 8, a group delay of the phase equalizer is shown after the non-linear, complex smoothing. The x-axis logarithmically shows the frequency $f_m$ in Hz. The y-axis shows the group delay of the phase equalizer $\varphi_{X,FILT}(f_m)$ as a function of the frequency $f_m$. As shown in the example in FIG. 8, the dynamic response of the group delay decreases as the frequency increases. The temporal diffusion therefore may be substantially reduced/prevented.

Figure 9A:
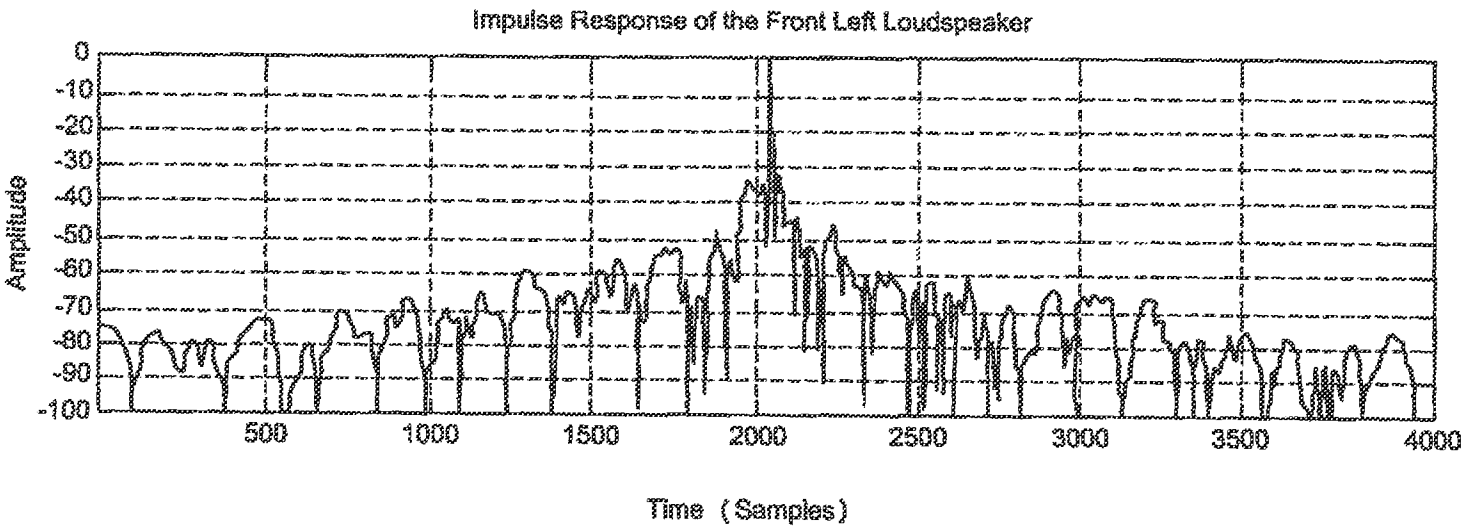
FIGS. 9A and 9B are graphical representations of the impulse response or the phase equalizer of the front left channel shown in FIG. 8.
Figure 9B:
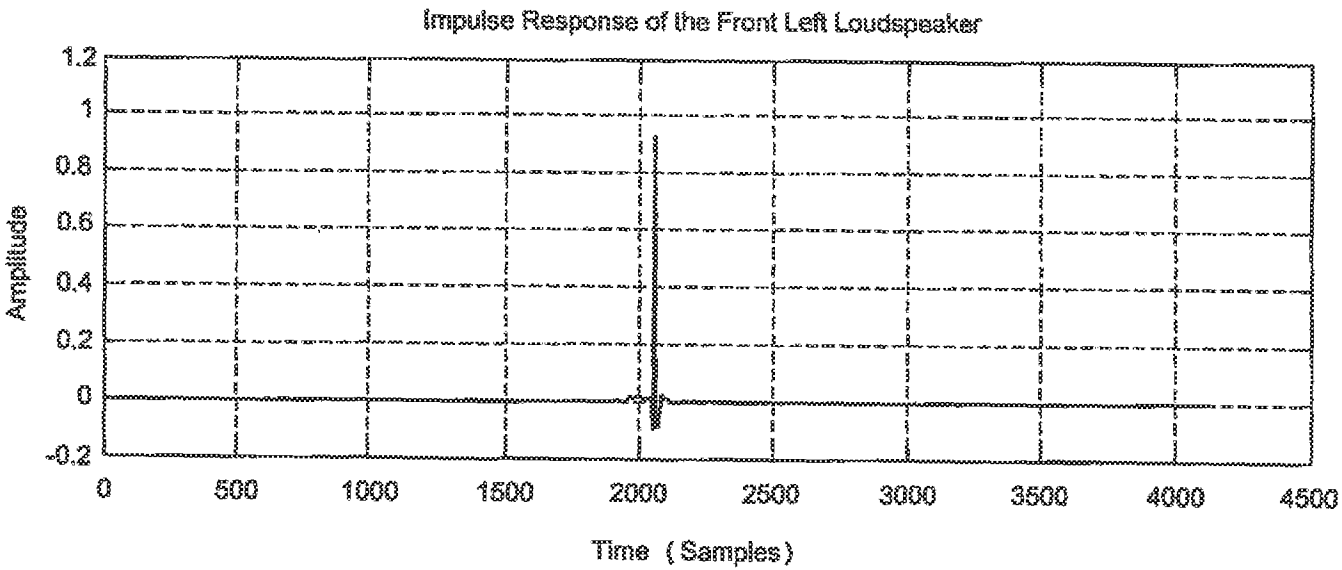

Referring to FIGS. 9A and 9B, an impulse response is shown for the FIR phase equalizer of the front left channel (i.e., the front left loudspeaker 2 shown in FIG. 3). Referring to FIG. 9A, a logarithmic representation is shown of the impulse response magnitude as a function of time. Referring to FIG. 9B, a linear representation is shown of the impulse response magnitude as a function of time.

Figure 10A:
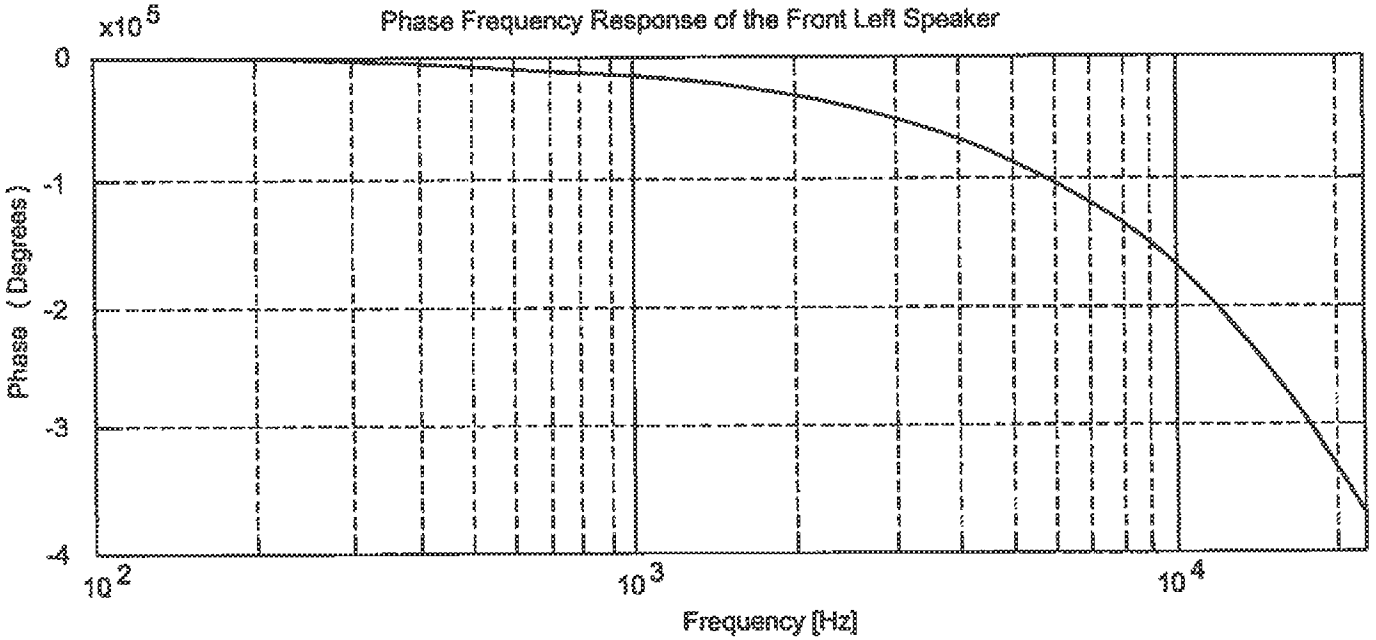
FIGS. 10A and 10B are Bode diagrams of the phase equalizer shown in FIG. 8.
Figure 10B:
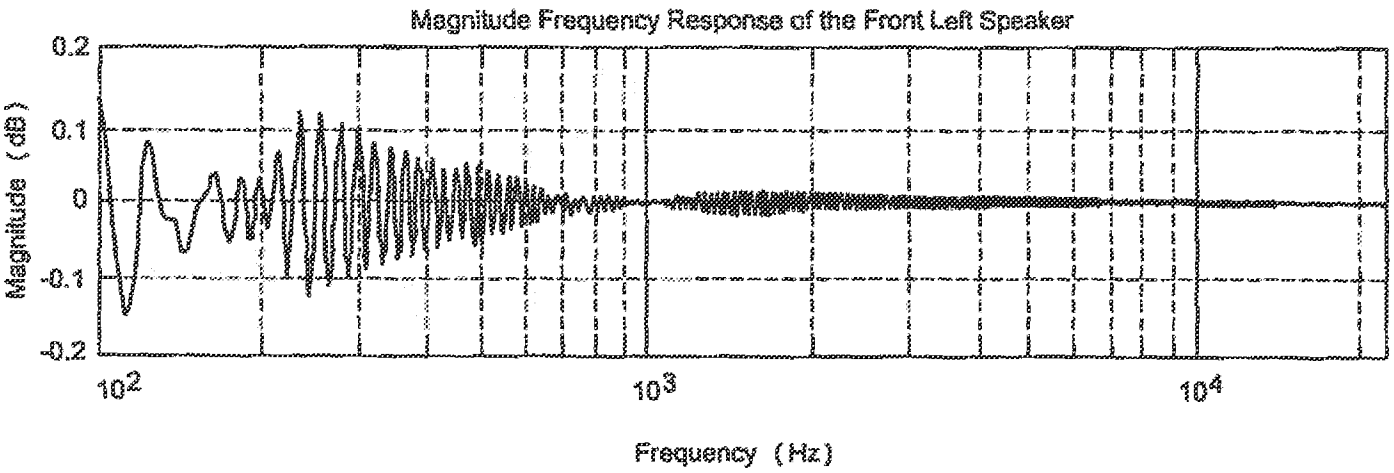

Referring to FIGS. 10A and 10B, a Bode diagram is shown of the phase equalizer $\varphi_{X,FILT}(f_m)$ in FIG. 9 configured as an FIR filter. FIG. 10A shows the frequency logarithmic scale (x-axis) plotted versus the phase (y-axis). FIG. 10B shows the frequency logarithmic scale (x-axis) plotted versus the level in decibels (dB).

The phase equalizer may be applied to the signal of the front left loudspeaker 2 (see FIG. 3). This procedure is also performed for the other loudspeakers in the relevant group; i.e., the front center and right loudspeakers 3 and 4 (see FIG. 3). Activation signals supplied to the front center and right loudspeakers 3 and 4 are phase equalized and processed as set forth above. Upon determining and applying optimum curves for phase equalization for the from loudspeakers and seating positions, optimization may also be performed for the rear seating positions. Localization of the audio signals may be optimized in a similar manner as described for the front seating positions using the side left and right loudspeakers 5 and 6 (see FIG. 3).

The aforedescribed method can improve localization of the audio signals at each of the listening positions in the passenger compartment without creating temporal diffusion and without unwanted changes in the magnitude frequency response by the phase equalizer.

Figure 11A:
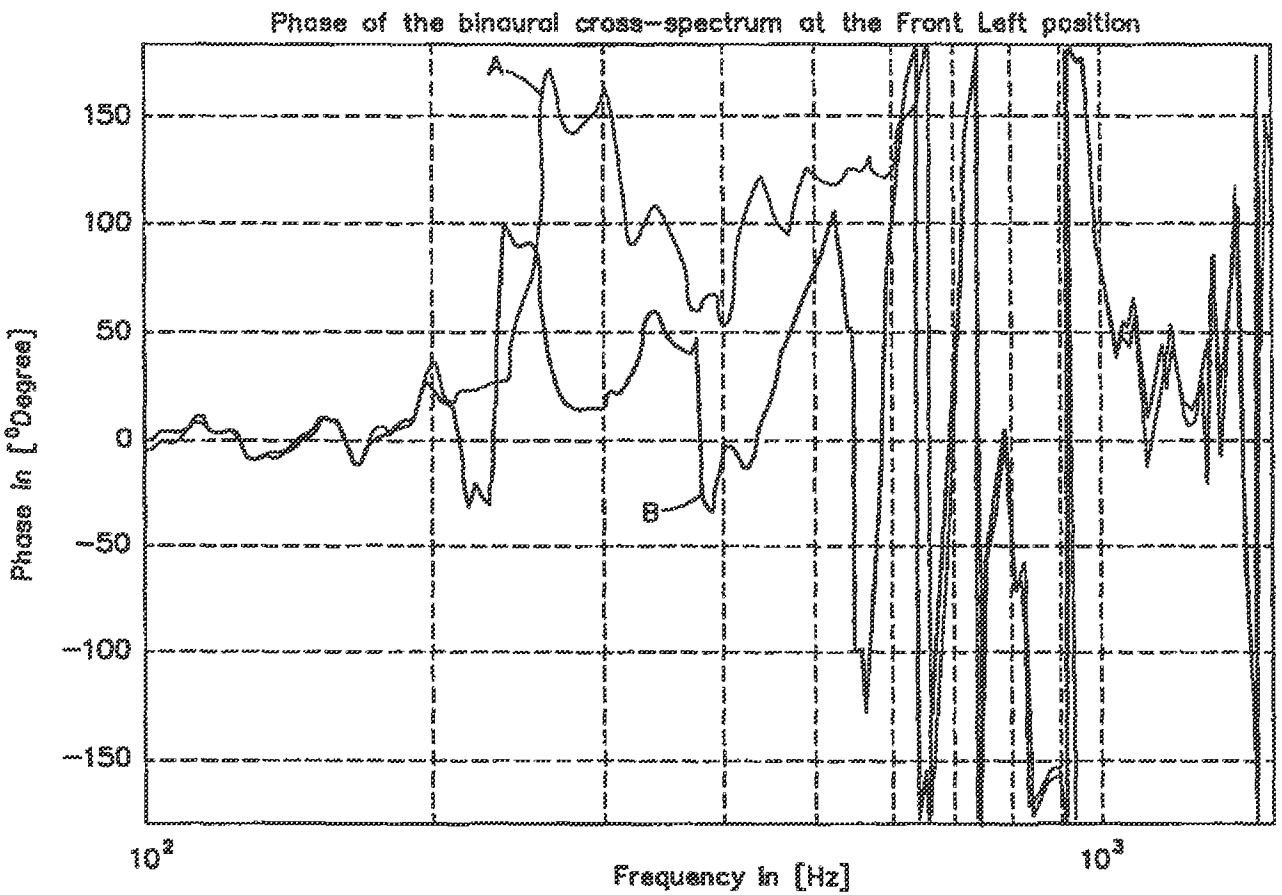
FIGS. 11A to 11D are graphical representations of phase differences of the binaural cross spectra at each seating position in the vehicle passenger compartment before and after phase equalization.
Figure 11B:
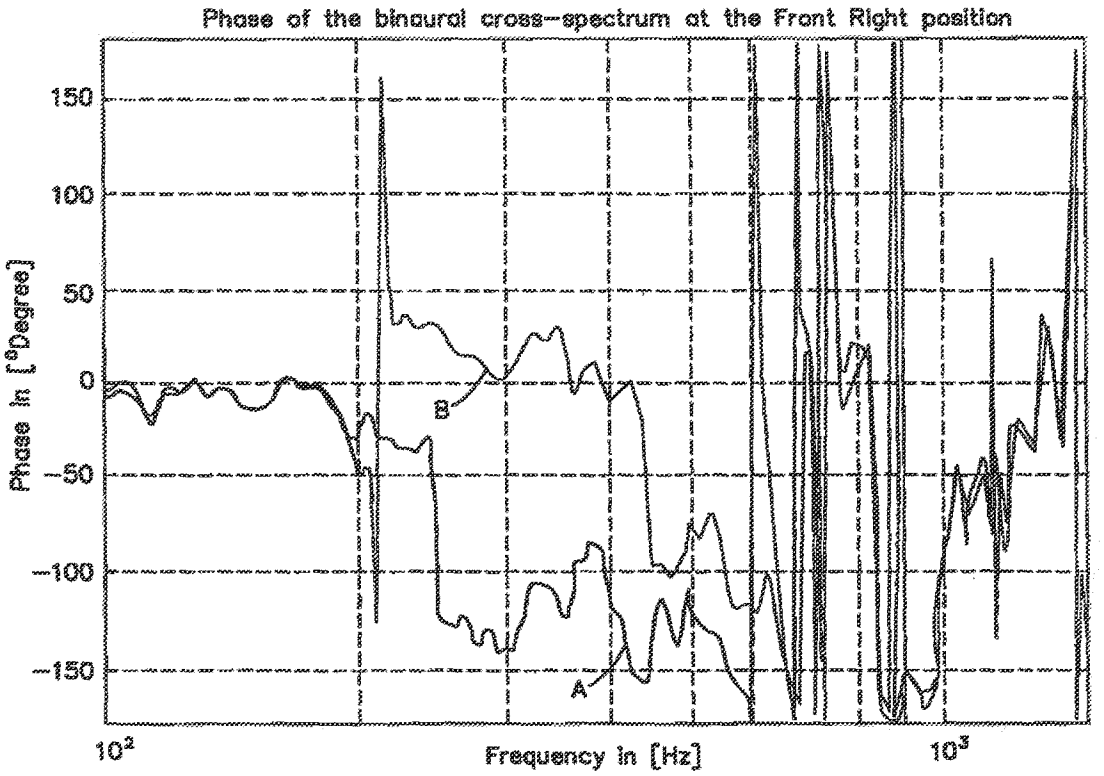
Figure 11C:
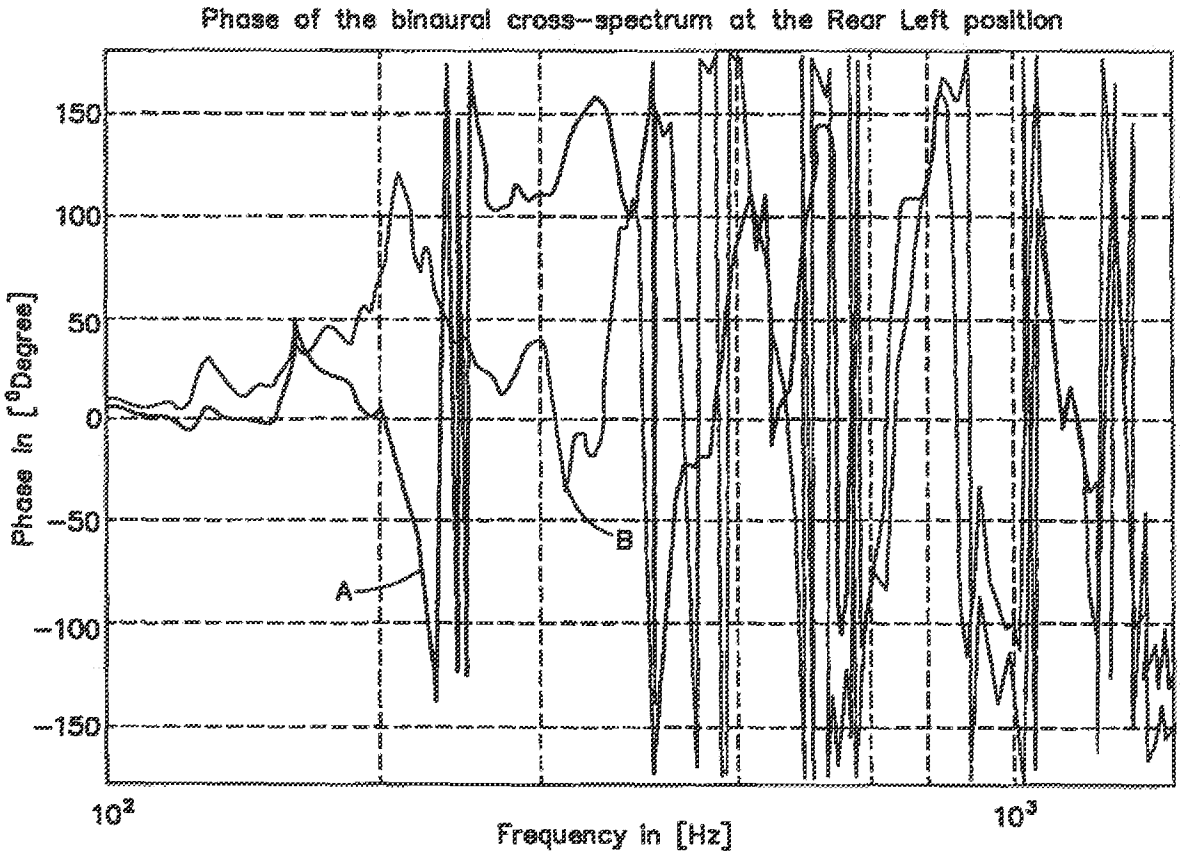
Figure 11D:
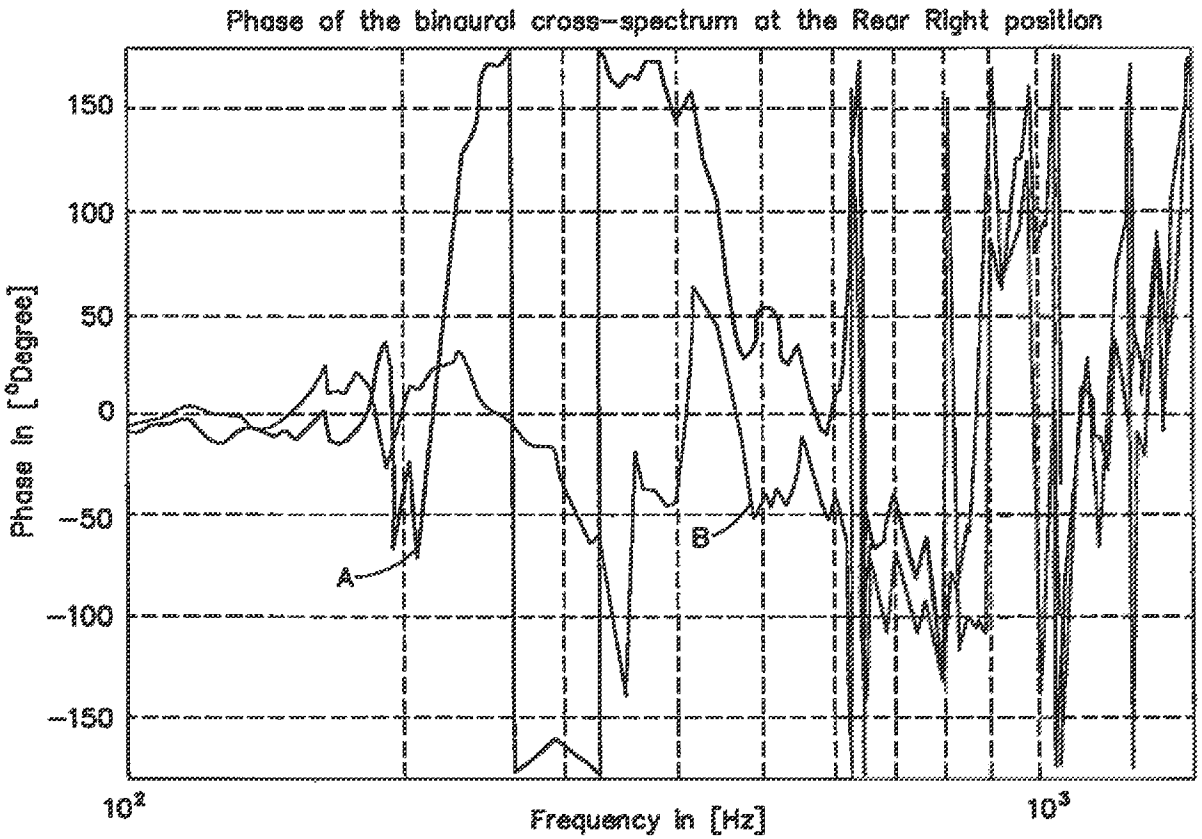

FIGS. 11A to 11D compare phase frequency responses for the binaural cross spectra measured at each of the four seating positions 10, 11, 12 and 13 in the vehicle passenger compartment before and after optimization (e.g., inserting the phase equalizers, phase function $\varphi_{X,FILT}(f_m)$ for all phase equalized channels). The x-axis logarithmically shows the frequency in Hz. The y-axis shows the binaural phase difference curve in degrees. FIG. 11A shows the binaural phase difference frequency responses for the front left seating position in the vehicle. FIG. 11B shows the binaural phase difference frequency responses for the front right seating position in the vehicle. FIG. 11C shows the binaural phase difference frequency responses for the rear left seating position in the vehicle. FIG. 11D shows the binaural phase difference frequency responses for the rear right seating position in the vehicle. The frequency dependent binaural phase differences determined prior to optimization are identified in the diagram by the letter "A". The frequency dependent binaural phase differences determined after optimization are identified by the letter "B". FIGS. 11A to 11D show that the deviation of the phase frequency response from an ideal zero line can be reduced at the lower frequencies for each seating position in the vehicle. The reduction in deviation can therefore significantly improve the localization within a vehicular audio system for each of the seating positions.

Figure 12:
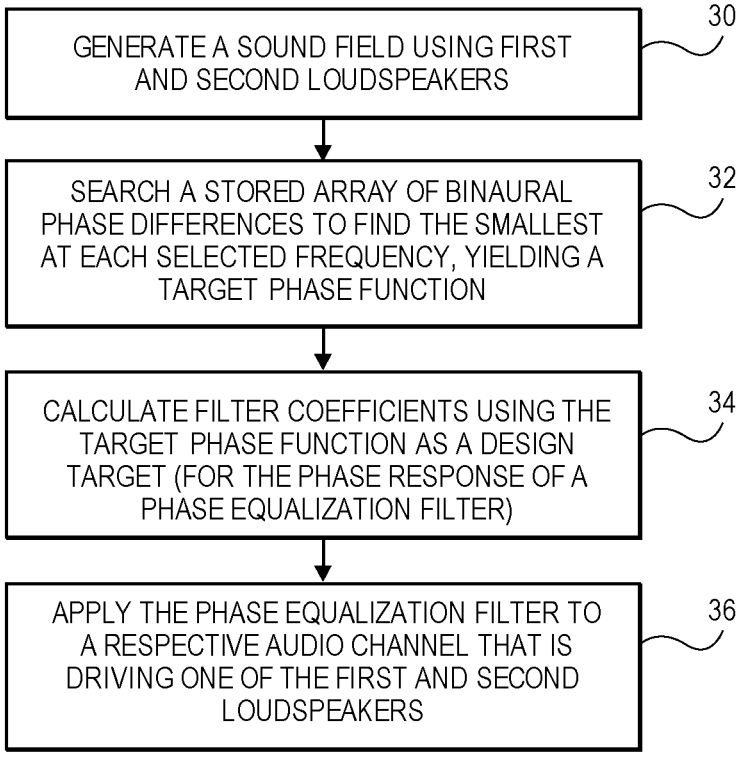
FIG. 12 is a flow diagram of a method for adjusting sound from multiple loudspeakers to reduce inter-aural time difference.

Referring to FIG. 12, a flow diagram of a computerized method is shown (that is performed by the multi-channel audio system of FIG. 3) that may be used to reduce interaural time difference, at a listening position (e.g., driver center seating position 10*b*) within a listening environment. As indicated above, a sound field may be generated by a group of loudspeakers assigned to the at least one listening position (block 30). The group of loudspeakers includes a first loudspeaker (e.g., the front left loudspeaker 2) and at least a second loudspeaker (e.g., the front right loudspeaker 4 and, optionally, the front center loudspeaker 3). Each loudspeaker receives an audio signal from an audio channel. A stored array of binaural phase differences is searched to find the smallest, at each selected frequency (block 32). Each binaural phase difference in the array is dependent on a respective frequency and a corresponding phase shift. This results in a "target phase function" that contains the corresponding phase shifts as a function of the selected frequencies. In one embodiment, the method includes calculating filter coefficients of a phase equalization filter for at least the audio channel supplying the second loudspeaker 4, using the target phase function as a design target for the phase response of the phase equalization filter (block 34). The phase response of the phase equalization filter is designed such that a binaural phase difference $\Delta\varphi_{mn}$ at the at least one listening position 10 is reduced, preferably minimized, within a predefined frequency range. Alternatively, where more than one listening position is considered, a mean binaural phase difference $m\Delta\varphi_{mn}$ averaged over more than one listening position (e.g., the front center seating positions 10*b* and 11*b*) is reduced, preferably minimized, within a predefined frequency range. The method also includes applying the phase equalization filter to the respective audio channel.

The interaural time differences which would be perceived by one or more listeners in respective listening positions (e.g., the front left seating position 10 and front right seating position 11 shown in FIG. 3) may be reduced. A binaural transfer characteristic may be determined for each loudspeaker 2, 4 of the group assigned to the considered listening positions 10, 11 in order to calculate the phase equalization filter. The binaural transfer characteristic may be determined using a dummy head as described above.

The optimization may be performed within a predefined frequency range. The predefined frequency range defines a set of frequencies $f_m$ and a set of phase shifts $\varphi_n$ (e.g., $\varphi_n=\{1°, 2°, \ldots, 180°\}$).

A binaural phase difference $\Delta\varphi_{mn}$ may be calculated at each considered listening position 10, 11. This calculation is performed for each frequency $f_m$ of the set of frequencies and for each phase shift $\varphi_n$ of the set of phase shifts. It is assumed, for the calculation of the binaural phase difference $\Delta\varphi_{mn}$, that an audio signal is supplied to each loudspeaker 2, 4, where the audio signal supplied to the second loudspeaker 4 is phase-shifted by a phase shift $\varphi_n$ relative to the audio signal supplied to the first loudspeaker 2. An array of binaural phase differences $\Delta\varphi_{mn}$ for each listening position 10, 11 is thus generated. An M×N matrix is provided where the group of loudspeakers includes two loudspeakers. The variable "M" corresponds to the number of different frequency values $f_m$, and the variable "N" corresponds to the number of different phase shifts $\varphi_n$. A M×N×N matrix is provided where the group of loudspeakers includes three loudspeaker (e.g., the front left, center and right loudspeakers 2, 3 and 4 shown in FIG. 3) when the same set of phase shifts $\varphi_n$ is applied to the audio signal supplied to the second and the third loudspeaker 3 and 4.

An array of mean binaural phase differences $m\Delta\varphi_{mn}$ may be calculated in order to improve localization at each of the listening positions. Each mean binaural phase difference $m\Delta\varphi_{mn}$ is a weighted average of the binaural phase differences $\Delta\varphi_{mn}$ at the considered listening positions 10, 11. The weighing factors may be zero or one or within the interval [0, 1]. Where a single listening position (e.g., the drivers position 10) is considered, however, the respective array of binaural phase differences $\Delta\varphi_{mn}$ at the drivers position 10 may be used as array $m\Delta\varphi_{mn}$.

The optimization may be performed by searching in the array of moan binaural phase differences $m\Delta\varphi_{mn}$ for an optimal phase shift $\varphi_X$ for each frequency $f_m$ to be applied to the audio signal fed to the at least one second loudspeaker 4. The optimum phase shift $\varphi_X$ is defined to yield a minimum of the mean binaural phase differences $m\Delta\varphi_{mn}$. A phase function $\varphi_{X,FILT}(f_m)$ therefore can be determined for the at least one second loudspeaker representing the optimal phase shift $\varphi_X$ as a function of frequency $f_m$. Where additional loudspeakers are considered (e.g., the from center loudspeaker 3 in FIG. 3) the optimum phase shift $\varphi_X$ is a vector having optimal phase shifts for the audio signals supplied to the second and each additional loudspeaker 3, 4.

The binaural phase differences $\Delta\varphi_{mn}$ are the phases of the cross spectrum of the acoustic signals present at each listening position. These cross spectrum may be calculated (or simulated) using the audio signals supplied to the loudspeakers of the relevant group of loudspeakers and the previously measured corresponding BRIR.

The method uses the measured binaural room impulse responses (BRIR) to simulate the acoustic signal that would be present when, as assumed in the calculation, an audio signal is supplied to each of the relevant loudspeakers, and phase shifts are inserted in the supply channel of the at least one second loudspeaker. The corresponding interaural phase differences may be derived from the simulated (binaural) signals at each listening position. This simulation however may be replaced by actual measurements. In other words, the audio signals in the simulation may actually be supplied to the loudspeakers and the resulting acoustic signals at the listening positions may be measured binaurally. The interaural phase differences may be determined from the measured signal in a similar manner as described above. A matrix of interaural phase differences is therefore produced similar to the one discussed above with respect to the "offline" method based on simulation. This matrix of interaural phase differences is similarly processed in both cases. In the embodiment that uses actual measurements, however, the frequency and the phases of the audio signals radiated by the loudspeakers are varied, where in the "offline" method the variation is performed in a computer having memory and that is executing a program stored in the memory—see FIG. 3.

Although various examples to realize the invention have been disclosed, it will be apparent to those skilled in the art that various changes and modifications can be made which will achieve some of the advantages of the invention without departing from the spirit and scope of the invention. It will be obvious to those reasonably skilled in the art that other components performing the same functions may be suitably substituted. Such modifications to the inventive concept are intended to be covered by the appended claims. Furthermore, the scope of the invention is not limited to automotive applications but may also be applied in any other environment such as in consumer applications (e.g., home cinemas or the like) and cinema and concert halls or the like.

What is claimed:

1. A method for adjusting sound from multiple loudspeakers to reduce inter-aural time difference at one or more listening positions within a listening room; the method comprises:

generating a sound field by a group of loudspeakers assigned to at least one listening position, wherein the group of loudspeakers comprises a first loudspeaker and at least a second loudspeaker each being supplied by an audio signal via an audio channel;

performing a search within a stored array of binaural phase differences, wherein each of the binaural phase differences represents a phase difference between a left ear and a right ear at a respective listening position and is dependent on a respective frequency and a corresponding phase shift, to find i) a smallest binaural phase difference at each of a plurality of selected frequencies, and ii) the corresponding phase shift associated with the smallest binaural phase difference, wherein performing the search yields a target phase function that contains the corresponding phase shifts, of the smallest binaural phase differences that were found, at the plurality of selected frequencies;

calculating filter coefficients of a phase equalization filter, for at least the audio channel supplying the second loudspeaker, using the target phase function as a design target for a phase response of the phase equalization filter, wherein the phase response of the phase equalization filter allows a binaural phase difference on the at least one listening position or a mean binaural phase difference averaged over more than one listening position to be minimized within a predefined frequency range; and applying the phase equalization filter to the audio channel supplying the second loudspeaker.

2. The method of claim 1, further comprising:

determining, for each listening position, a binaural transfer characteristic for each loudspeaker of the group assigned to the respective listening position;

selecting a set of frequencies from thea predefined frequency range and a set of phase shifts from a predefined phase range; and calculating a binaural phase difference for each listening position, for each frequency of the set of frequencies and for each phase shift of the set of phase shifts assuming for the calculation of the binaural phase difference that the audio signal is supplied to each loudspeaker via the audio channel, where the audio signal supplied to the at least one second loudspeaker is phase-shifted by the phase shift relatively to the audio signal supplied to the first loudspeaker, thus providing said array of binaural phase differences for the respective listening position.

3. The method of claim 2, where calculating a binaural phase difference at each listening position comprises:

calculating a cross-spectrum value at each listening position, for each frequency of the set of frequencies and for each phase shift of the set of phase shifts; and calculating phase of a cross spectrum for each calculated cross-spectrum value, the phase of the cross spectrum representing the binaural phase difference at each listening position.

4. The method of claim 2 wherein determining the binaural transfer characteristics comprises:

sequentially supplying a broad band test signal to each loudspeaker;

binaurally measuring the resulting acoustic signals arriving at each listening position; and calculating for each pair of loudspeaker and listening position a corresponding binaural transfer characteristics.

5. The method of claim 1, further comprising smoothing the target phase function before using it in calculating the phase response of the phase equalization filter.

6. The method of claim 5, where the smoothing is performed with a nonlinear, complex smoothing filter.

7. The method of claim 5, where the smoothing is performed with a smoothing filter whose dynamic response decreases with an increasing frequency.

8. The method of claim 1, further comprising:

selecting a set of frequencies from a predefined frequency range and a set of phase shifts from a predefined phase range;

supplying, for each selected frequency, an audio signal having the selected frequency to each loudspeaker for generating the sound field, where the audio signal supplied to the at least one second loudspeaker is phase-shifted by a respective one of the set of phase shifts, relative to the audio signal supplied to the first loudspeaker;

binaurally measuring for each combination of phase shift and frequency the resulting acoustic signal arriving at each listening position; and calculating a binaural phase difference for each listening position from the respective binaurally measured acoustic signals, thus providing said array of binaural phase differences for each listening position comprising a binaural phase difference value for each combination of phase shift and frequency.

9. The method of claim 1 wherein the filter coefficients of the phase equalization filter are calculated to yield the phase equalization filter as having a phase response that minimizes the binaural phase difference or the mean binaural phase difference across all of the predefined frequency range being 100 Hz-1500 Hz.

10. A system for adjusting sound from multiple loudspeakers to reduce inter-aural time difference at one or more listening positions within a listening room, the system comprising:

a group of loudspeakers assigned to at least one listening position for generating a sound field, the group of loudspeakers including a first loudspeaker and at least a second loudspeaker; and a signal source providing an audio signal to each of the loudspeakers via a respective audio channel;

a computer having memory in which a program is stored that, when executed by the computer, calculates filter coefficients of a phase equalization filter for being applied to the audio channel supplying the second loudspeaker, wherein the phase equalization filter has a phase response that is designed such that a binaural phase difference on the at least one listening position or a mean binaural phase difference averaged over more than one listening position is reduced within a predefined frequency range, the binaural phase difference being phase difference between the left ear and the right ear of a listener at a respective listening position, wherein the program, when executed by the computer, performs a search within an array that is stored in the memory and that contains binaural phase differences which have been computed using a binaural transfer characteristic at the respective listening position, wherein each binaural phase difference was computed for a respective frequency and a corresponding phase shift, wherein the search is to find a smallest binaural phase difference in the array at each selected frequency, wherein the smallest binaural phase difference that is found has a corresponding phase-shift, to yield a plurality of corresponding phase-shifts each at a different selected frequency, and wherein the computer is to compute a phase response of the phase equalization filter that approximates the plurality of corresponding phase shifts.

11. The system of claim 10, wherein, to calculate the coefficients of a phase equalization filter, the computer is configured for:

determining, for each listening position, a binaural transfer characteristic for each loudspeaker of the group assigned to the respective listening position;

selecting a set of frequencies from the predefined frequency range and a set of phase shifts from a predefined phase range;

calculating a binaural phase difference for each listening position, for each frequency of the set of frequencies and for each phase shift of the set of phase shifts thereby assuming for the calculation that an audio signal is supplied to each loudspeaker, where the audio signal supplied to the at least one second loudspeaker is phase-shifted by the phase shift relative to the audio signal supplied to the first loudspeaker (2), thus providing said array of binaural phase differences for the respective listening position; and providing an array of mean binaural phase differences by calculating a weighted average of the binaural phase differences at a plurality of listening positions.

12. The system of claim 10 further comprising a smoothing filter that is configured to smooth the plurality of corresponding phase shifts before calculating the phase response of the phase equalization filter.

13. The system of claim 12, where the smoothing filter is a nonlinear, complex smoothing filter whose dynamic response decreases with an increasing frequency.

14. The system of claim 10 wherein the computer is configured to reduce the binaural phase difference or the mean binaural phase difference across all of the predefined frequency range being 100 Hz-1500 Hz.

* * * * *